United States Patent [19]

Charniga

[11] 4,455,802

[45] Jun. 26, 1984

[54] WIRE SCREEN FIRE STOPS

[76] Inventor: Joseph Charniga, P.O. Box 292, New Middletown, Ohio 44442

[21] Appl. No.: 389,223

[22] Filed: Jun. 17, 1982

[51] Int. Cl.[3] ..... E04B 1/94

[52] U.S. Cl. ..... 52/317; 52/222

[58] Field of Search ..... 52/317, 406, 407, 404, 52/727, 220, 221

[56] References Cited

U.S. PATENT DOCUMENTS

| | | | |
|---|---|---|---|
| 293,617 | 2/1884 | Bartlett | 52/317 |
| 1,534,103 | 4/1925 | Foss | 52/317 |
| 1,719,728 | 7/1929 | Saunders | 52/317 |
| 1,867,449 | 7/1932 | Ecret et al. | 52/317 |
| 2,116,668 | 5/1938 | Cross | 52/662 |
| 2,341,305 | 2/1944 | Woodworth | 52/317 |
| 2,353,045 | 7/1944 | Kantz | 52/145 |
| 2,777,786 | 1/1957 | Schwartz | 52/406 |
| 3,757,477 | 9/1973 | McCrillis | 52/317 |
| 3,786,604 | 1/1974 | Kramer | 52/317 |
| 4,069,628 | 1/1978 | Kreimer | 52/317 |
| 4,292,777 | 10/1981 | Story | 52/407 |
| 4,297,821 | 11/1981 | Peters | 52/317 |

*Primary Examiner*—Henry E. Raduazo

*Attorney, Agent, or Firm*—Harpman & Harpman

[57] ABSTRACT

Fire stops for structures formed of combustible materials such as frame dwellings and the like are formed of wire screen with support frames and positioned in spaced relation below wooden floor joists and wooden plates and other transverse wooden members positioned between wooden studding and the like in such structures. The wire screen introduces an element of high heat conductivity and effectively prevents the upward propagation of flame therethrough. Perforated metal sheets in contact with said wire screen support the same.

2 Claims, 3 Drawing Figures

WIRE SCREEN FIRE STOPS

BACKGROUND OF THE INVENTION (1) Technical Field

This invention relates to fire stops usable in wooden frame structures such as dwelling houses.

(2) Description of the Prior Art

The prior art discloses the use of wire screen or its equivalent in two applications; one, the use of wire screen baskets filled with sound deadening materials and positioned in walls as seen in U.S. Pat. No. 2,341,305. Wire screen is shown in enveloping relation to a metal I-beam and disposed on the vertical surface of a truss in U.S. Pat. No. 4,297,821 for preventing the spread of fire or flame. No prior art is known wherein wire screen is arranged on apertured metal sheets and positioned below wooden structural members in a frame structure for preventing the upward propagation of flame by reason of relatively high heat conductivity of the wire screen over a substantially large area in relation to the flame path, the conductivity being greatly increased by the apertured sheets.

SUMMARY OF THE INVENTION

Building structures of combustible materials such as wooden framing members are commonly associated with dwelling houses of the so-called frame type. The exposed floor joists and subfloor constructions in such frame structures may be effectively protected by wire screen fire stops positioned therebelow and the upward propagation of flame between vertical studding and below horizontal plates and other wooden members in the frame structure can be effectively controlled by the positioning of wire screen fire stops in spaced relation below such members. The wire screen fire stops act to lower the temperature of the fire by their high heat conductivity.

DESCRIPTION OF THE PREFERRED EMBODIMENT

Figure 3:
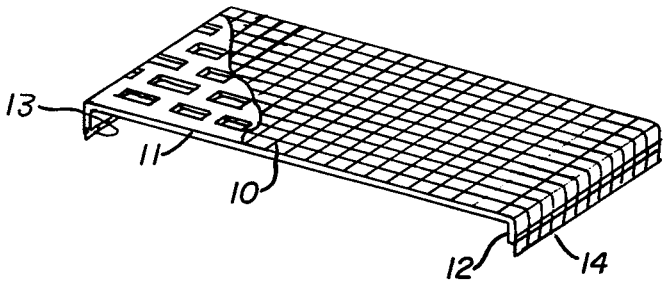
FIG. 3 is a perspective view of a wire screen fire stop with the wire screen mesh being greatly enlarged, with parts broken away.

By referring to the drawings and FIG. 3 in particular, it will seen that a wire screen fire stop has been disclosed as being formed of wire screen mesh 10, the mesh being enlarged in exaggerated detail and comprising steel wire screen mesh having thicknesses from 0.010 inches to 0.020 inches with from 18 to 22 strands per inch. Metal sheets 11 flanged at 12 are perforated rolled steel shapes, extend between downturned end sections 13 and 14 of the wire screen mesh 10 so that the flexible fire stop thus formed is of an overall length to enable it to be positioned between supporting members such as hereinafter disclosed. The width of the wire screen fire stop seen in FIG. 3 may be any desired width to match the corresponding desired area of the location in which the fire stop is installed.

Figure 1:
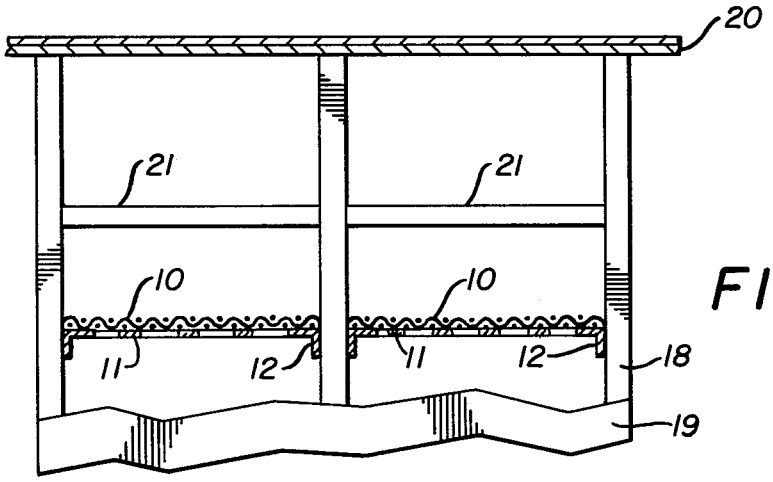
FIG. 1 is a side elevation of an upper portion of a frame wall structure showing wire screen fire stops installed therein.
Figure 2:
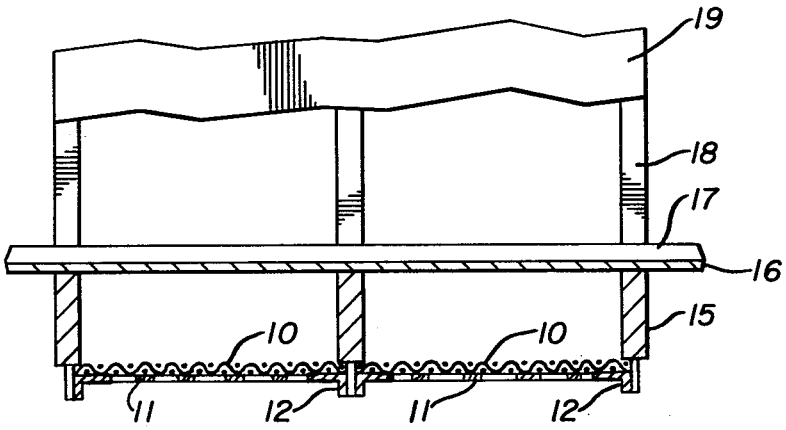
FIG. 2 is a side elevation of a portion of a frame structure showing a floor and supporting joists and a plate and studding positioned thereon with wire screen fire stops installed thereon.

By referring now to FIG. 2 of the drawings, it will be seen that a portion of a frame structure has been disclosed in which horizontal wooden joists 15 are shown supporting a wooden subfloor 16 on which a wooden plate 17 supports a plurality of horizontally spaced vertically standing wooden studding 18. A portion of a dry wall or similar material 19 is broken away to illustrate the hollow cavities formed between the studding 18. A similar sectional elevation is seen in FIG. 1 of the drawings, the studding 18 extending vertically above the broken away section of dry wall 19, a secondary plate 20 extends across the top of the studding 18 and wooden fire stops 21 are positioned between the studding 18 in the cavities heretofore referred to.

In FIG. 1 of the drawings, wire screen fire stops comprising the wire screen mesh 10 and the perforated metal sheets 11 may be seen installed between the studding 18 below the wooden fire stops 21. In FIG. 2 of the drawings, the wire screen fire stops comprising the wire screen mesh 10 and the perforated sheets 11 may be seen installed immediately adjacent the lower portions of the wooden joists 15.

It will occur to those skilled in the art that if desired, additional wire screen fire stops may be installed above the wooden fire stops 21 and below the secondary plate 20 in the illustration comprising FIG. 1 and an alternate positioning of the wire screen fire stops in FIG. 2 of the drawings may comprise locating the same immediately below the lower surfaces of the wooden joists 15 as by suspending the combination fire stops therefrom by suitable means, not shown.

In the illustrations comprising FIGS. 1 and 2 of the drawings, the wire screen fire stops are positioned relative to the wooden joists 15, the sub-floor 16, the plate 17 and the wooden fire stops 21 so as to prevent the propagation of flame necessary to involve these wooden members in a fire originating therebelow. The wire screen mesh 10 is preferably formed of steel for economy, but may be alternately formed of other metals such as copper, brass, or aluminum and those skilled in the art will observe that such wire screen will have a thermal conductivity sufficient to lower the temperature of flames in a fire reaching the same to prevent propagation of the fire upwardly therethrough. It is essential that the wire screen fire stop be vertically spaced in relation to the protected wooden framing members as illustrated and described herein and it will be observed that the wire screen fire stops permit air to circulate in the protected areas which insures against moisture damage or the like which would otherwise occur.

The wire screen fire stops disclosed herein can be quickly and easily and economically added to frame building constructions during the construction thereof without interfering with the building codes fire stops requirements as known in the art.

Although but one embodiment of the present invention has been illustrated and described, it will be apparent to those skilled in the art that various changes and modifications may be made therein without departing from the spirit of the invention and having thus described my invention what I claim is:

1. In a building structure of the wooden frame type having vertically and horizontally positioned frame members, the improvement comprising means for stopping the upward propagation of fire, said means consisting of horizontally disposed rectangular fire stops formed of perforated metal sheets and metal screen mesh, said metal screen mesh being positioned on and supported by said perforated metal sheets, flanges formed on oppositely disposed edge portions of said metal sheets, means attaching said flanges to said frame members so as to position said fire stops in said building structure in vertically spaced relation to the surfaces of said horizontally disposed wooden members thereof.

2. The means for stopping the propagation of a fire in a building structure set forth in claim 1 and wherein said metal screen mesh is formed of wires having a thickness from 0.010 inches to 0.020 inches and with from 18 to 22 wires per inch and the perforated metal sheets are 20 gauge.

* * * * *